US005634597A

United States Patent [19]

Krohn et al.

[11] Patent Number: 5,634,597

[45] Date of Patent: Jun. 3, 1997

[54] ELECTROMAGNETICALLY ACTUATED FUEL INJECTION VALVE

[75] Inventors: Klaus-Henning Krohn; Waldemar Hans; Christian Preussner, all of Bamberg; Johann Bayer, Strullendorf, all of Germany

[73] Assignee: Robert Bosch GmbH, Germany

[21] Appl. No.: 470,784

[22] Filed: Jun. 6, 1995

[30] Foreign Application Priority Data

Jun. 18, 1994 [DE] Germany ..... 44 21 429.4

[51] Int. Cl.[6] ..... F02M 51/00

[52] U.S. Cl. ..... 239/585.5; 239/600

[58] Field of Search ..... 239/585.1–585.5, 239/600

[56] References Cited

U.S. PATENT DOCUMENTS

| | | | |
|---|---|---|---|
| 5,150,842 | 9/1992 | Hickey | 239/585.4 |
| 5,295,627 | 3/1994 | Wahba . | |
| 5,392,995 | 2/1995 | Wahba | 239/585.4 |
| 5,494,224 | 2/1996 | Hall et al. | 239/585.5 |

FOREIGN PATENT DOCUMENTS

| | | | |
|---|---|---|---|
| 0 348 786 B1 | 1/1990 | European Pat. Off. . | |
| 0 487 199 | 5/1992 | European Pat. Off. . | |
| 2 526 875 | 11/1993 | France . | |
| 4 230 376 | 4/1993 | Germany . | |
| 2-241971 | 9/1990 | Japan | 239/585.4 |
| 3-264767 | 11/1991 | Japan | 239/585.4 |
| 2 198 589 | 6/1988 | United Kingdom . | |

*Primary Examiner*—Kevin Weldon
*Attorney, Agent, or Firm*—Kenyon & Kenyon

[57] ABSTRACT

In a fuel injection valve, the direct attachment of a protective sleeve to the valve housing has the effect that breathing of the inside of the valve can take place without spray water or other fluids penetrating into the inside of the valve (coil space). The fluid is, rather, held in a space with many passages. Corrosion on the contact pins or on the coil wire is, therefore, ruled out. The fuel injection valve is particularly suitable for use in fuel injection systems of mixture-compressing internal combustion engines with externally supplied ignition.

11 Claims, 2 Drawing Sheets

ELECTROMAGNETICALLY ACTUATED FUEL INJECTION VALVE

BACKGROUND OF THE INVENTION

The present invention is based on an electromagnetically actuated fuel injection valve. Numerous fuel injection valves are already known (from European Patent 0 348 786, for example) which have an electrical connecting plug by means of which the electrical contacting of a magnet coil, and therefore its excitation, takes place. Contacting per se takes place by means of metallic contact pins which extend from the magnet coil to the actual connecting plug and which are largely extrusion-coated with plastic. The extrusion coating then encloses the valve housing, at least partially.

The connection between the plastic extrusion coating and the contact pins and the valve housing is not pressure-tight. It is, rather, the case that extremely fine capillary gaps are formed after the extrusion coating due to the shrinkage behavior of the plastic and these capillary gaps represent a connection between the coil space and the external surroundings.

During operation of the internal combustion engine and of the fuel injection valve, the coil space of the magnet coil is heated. A compensatory volume flow takes place between the heated, expanding air within the valve and the atmosphere surrounding the valve. If the valve is cooled down from the warm operating condition, ambient air is induced into the coil space via the capillary gaps between the plastic extrusion coating, on the one hand, and the contact pins and valve housing, on the other; the inside of the valve "breathes". If the cooling of the injection valve takes place due to spray water or if spray water is present at the capillaries during cooling, the fluid is sucked into the valve, in particular into the coil space. The result is corrosion on the contact pins and the coil wire. This can lead to destruction of the coil wire.

ADVANTAGES OF THE INVENTION

The fuel injection valve according to the present invention, has—in contrast—the advantage that unhindered "breathing" of the internal space in the valve can take place without spray water or other fluids, which may be present, being transported into the valve, particularly into the coil space and onto the contact pins. For this purpose, it is advantageous to fasten a low-cost and robust protective sleeve on the outer periphery of the valve without closing capillaries which may possibly occur between the plastic extrusion coating and valve housing. Fluid present is, namely, now induced between the valve housing and the protective sleeve without any noticeable resistance during the "breathing" of the valve, without the fluid reaching the inside of the valve. This is ensured because the volume formed between the protective sleeve and the valve housing is larger than the volume needed to compensate for the "breathing" due to the increase in temperature of the air enclosed within the valve.

The formation of numerous small passages in the protective sleeve, which are formed by narrow ribs so that a large internal volume with a large surface appears, is of particular advantage. This ensures that even in the case of vibration loads or changes in position, the induced fluid is kept away from the capillary gaps. The capillary retention forces occurring because of the small passages prevent, namely, the displacement of the induced fluid. Because the fuel injection valve is repeatedly heated, the small quantities of fluid induced evaporate again after a short time but this is not a precondition for the functioning of the protective sleeve.

It can be advantageous to provide a compensation hole in the valve housing if the capillary gaps are not sufficient for unpressurized volume compensation between the coil space and the space formed between the valve housing and the protective sleeve.

DESCRIPTION OF THE EXEMPLARY EMBODIMENTS

Figure 1:
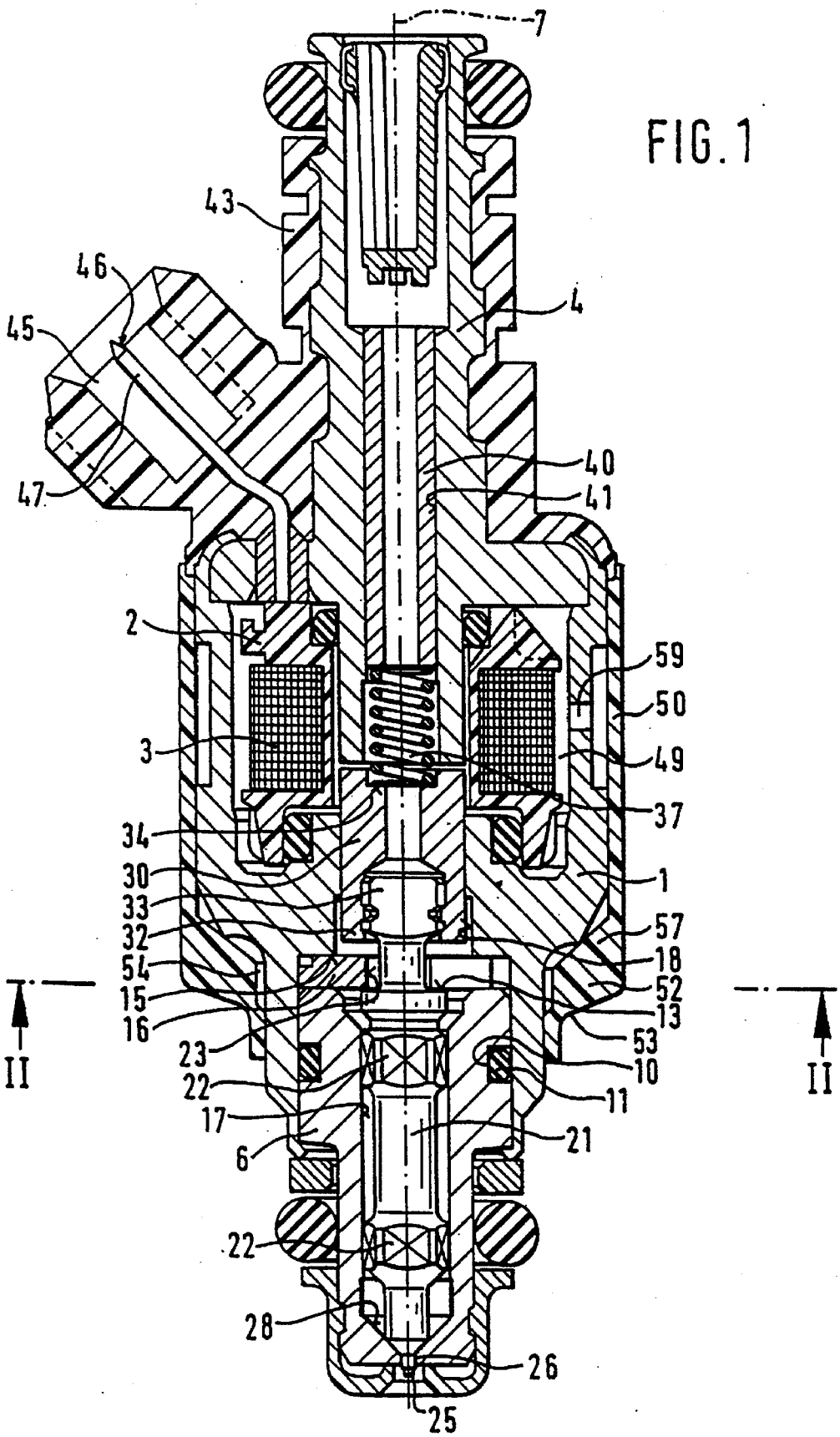
FIG. 1 shows a fuel injection valve according to the present invention.

The electromagnetically actuated fuel injection valve for fuel injection systems of internal combustion engines, shown as an example in FIG. 1, has a tubular valve housing 1 of a ferromagnetic material, within which a magnet coil 3 is arranged on a coil carrier 2. The coil carrier 2 partially surrounds a step-shaped core 4 which extends concentrically to a longitudinal valve axis 7, has a tubular shape and is used to supply the fuel. At its end facing away from the magnet coil 3, the valve housing 1 partially encloses a nozzle body 6 in the axial direction. In order to provide a fluid-tight seal between the valve housing 1 and the nozzle body 6, an annular groove 10, in which a sealing ring 11 is arranged, is formed on the periphery of the nozzle body 6.

A stop plate 16, which serves to limit the motion of a valve needle 21 that is arranged in a stepped longitudinal hole 17 of the nozzle body 6 having a guide region and projects into a stepped longitudinal opening 18 of the valve housing 1, is clamped between an end surface 13 of the nozzle body 6 facing the magnet coil 3 and an inner shoulder 15 of the valve housing 1 lying axially opposed to the end surface 13. Two guide sections 22 of the valve needle 21 which are, for example, configured as squares are led through the guide region of the longitudinal hole 17; they also, however, leave an axial passage free for the fuel. The valve needle 21 penetrates a passage opening 23 of the stop plate 16 with radial clearance and a needle pintle 25 at its downstream end protrudes from an injection opening 26 of the nozzle body 6. A frustoconical seating surface 28 is formed on the nozzle body 6 at the downstream end facing away from stop plate 16 and it interacts with an end of the valve needle 21 acting as the valve closing part and effects the opening and closing of the fuel injection valve.

At its other end, the valve needle 21 is firmly connected to a tubular armature 30 since the latter surrounds a retention part 33 of the valve needle 21 by means of a region 32 facing towards the seating surface 28. One end of a return spring 37 is in contact with a shoulder 34 of the armature 30 facing the magnet coil 3. The other end of the return spring 37 is braced against a tubular adjusting sleeve 40 which is pressed into a stepped through-hole 41 of the core In the axial direction, the core 4 and the valve housing 1 are enclosed at least partially by a plastic extrusion coating 43. An electrical connecting plug 45, by means of which the magnet coil 3 is electrically contacted and therefore excited, is formed jointly, for example, with the plastic extrusion coating 43. The connecting plug 45 manufactured from plastic includes, for example, two metallic contact pins 46 which are in direct connection with the winding of the magnet coil 3. The contact pins 46 protrude upstream from the coil carrier 2 surrounding the magnet coil 3 and are largely extrusion-coated with plastic. It is only at their ends 47 that the contact pins 46 are exposed; they are therefore not directly enclosed by plastic 80 that a plug connection with a corresponding plug part (not shown) is possible.

Connections between plastic parts and metal parts are not completely leak-tight. On fuel injection valves also, therefore, it is not possible to ensure complete leak-tightness in the region of the contact pins 46 which are extrusion-coated with plastic and in the region of the end facing towards the injection opening 26 of the plastic extrusion coating 43 on the valve housing 1. It is, rather, the case that extremely fine capillary gaps are formed between the metal parts, such as the contact pins 46, and the plastic covering 3. This effect is intensified further under the action of heat, in particular, because the different thermal expansion coefficients of plastic and metal lead to material displacements. During operation of the internal combustion engine and of the fuel injection valve, an increase in temperature in the region of the magnet coil 3 and the connecting plug 45 is caused precisely by the internal combustion engine and also by the heating of the magnet coil 3, which in turn intensifies the formation of capillary gaps. The extremely fine capillary gaps ensure that direct connections exist between the air trapped between the coil carrier 2 and the valve housing 1, on the one hand, and the atmosphere existing outside the fuel injection valve, on the other; so that the fuel injection valve can "breathe".

In the case of an increase in temperature during the operation of the fuel injection valve, the internal pressure decreases towards the outside via the capillary gaps because of the expansion in the volume of the magnet coil 3 and the enclosed air so that a pressure balance is maintained. On cooling, the pressure is compensated in the opposite direction. The danger of fluid entering the inside of the fuel injection valve is particularly great when the internal combustion engine is greatly endangered by spray water. It is not only pure water which can be sucked into the capillary gaps; other particles (for example salts) can also be entrained with it, so that the corrosion in the coil space 49 can even be accelerated and destruction of the coil wire is not ruled out.

In accordance with the present invention, this problem is solved by a protective sleeve 50 which is used as a spray water barrier and which encloses the outer periphery of the fuel injection valve, completely in the radial direction and at least partially in the axial direction. At its upper end facing towards the connecting plug 45, the tubular protective sleeve 50, which is manufactured for example from a plastic, is fastened in a leak-tight manner integrally, for example by means of ultrasonic welding, to the plastic extrusion coating 43, whereas the lower end of the protective sleeve 50 facing towards the injection opening 26 surrounds the valve housing 1 with a clearance fit. In consequence, the breathing air of the injection valve flows in each case, via the capillaries between the metal valve housing 1 and the plastic extrusion coating 43, into an annular gap formed between the valve housing 1 and the protective sleeve 50. Other materials apart from plastic, such as metals, can also be employed for the protective sleeve 50. At its end 52 facing towards the injection opening 26, the protective sleeve 50 has a stepped configuration similar to the outer contour of the valve housing 1. The outer lower shoulder 53 of the protective sleeve 50, however, surrounds the valve housing 1 at a distance. The space 54 formed between the protective sleeve 50 and the valve housing 1 is used to accept and hold fluid which is induced between the protective sleeve 50 and the valve housing 1 due to "breathing".

Figure 2:
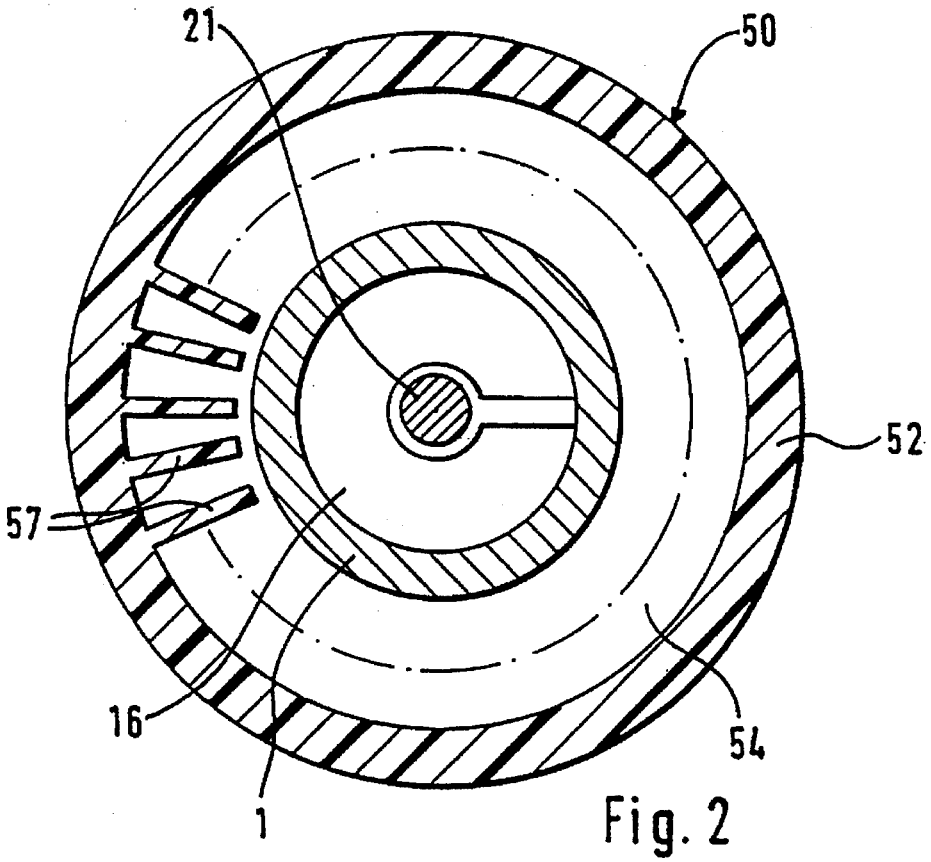
FIG. 2 shows a section along the line II—II through the fuel injection valve of FIG. 1.

The space 54 is subdivided into numerous small passages and capillaries which occur because of ribs 57 protruding radially inwards from the inner wall of the protective sleeve 50. Two ribs 57 then bound each intermediate passage. FIG. 2, which is a section through the fuel injection valve with the protective sleeve 50, clearly shows the configuration of the ribs 57. The volume of the passages formed between the ribs 57 is substantially greater than the breathing volume occurring over the operating temperature range of the internal combustion engine and of the fuel injection valve. This ensures that induced fluid does not reach the inside of the fuel injection valve. Because of the capillary retention forces, the labyrinth of many small passages formed by the ribs 57 prevents induced fluid from penetrating through to the coil space 49 sealed off from the fuel-carrying parts, even in the case of vibration loads or changes in position.

If the capillary gaps are not sufficient for unpressurized volume compensation between the coil space and the space 54 formed between the valve housing 1 and the protective sleeve 50, it can be advantageous to provide a compensation bore hole 59 from the coil space 49 to the periphery of the valve housing 1 in the region where the latter is covered by the protective sleeve 50.

Figure 3:
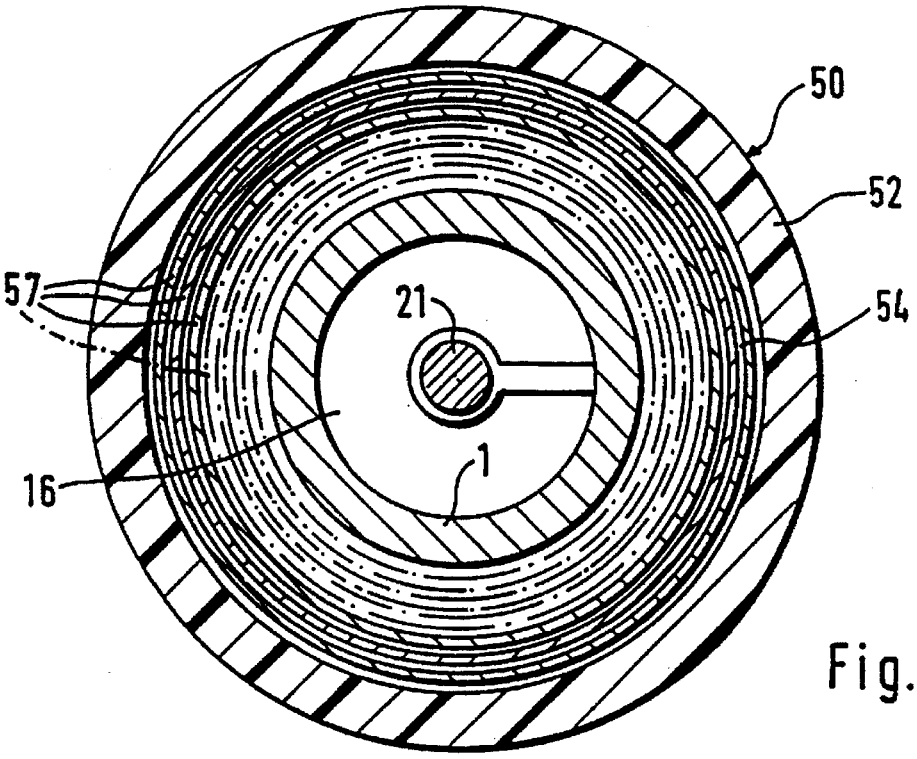
FIG. 3 shows a further example of the passage formation in the protective sleeve.

FIG. 3 shows a further exemplary embodiment of the formation of the labyrinth, including many passages, in the protective sleeve 50. In this case, the ribs 57 are not arranged so that they extend radially but are, rather, arranged in circular shape. Further embodiments (not shown) with a different arrangement of the passages similarly satisfy the function described.

What is claimed is:

1. An electromagnetically actuated fuel injection valve comprising:

a valve housing;

a protective sleeve having a first end and a second end, the protective sleeve surrounding the valve housing such that at least one space is formed between the first end of the protective sleeve and the valve housing; and a plastic covering being connected in a leak-tight manner to the second end of the protective sleeve.

2. The electromagnetically actuated fuel injection valve according to claim 1, wherein:

the protective sleeve is composed of plastic.

3. The electromagnetically actuated fuel injection valve according to claim 2, wherein:

the protective sleeve is fastened to the plastic covering by ultrasonic welding.

4. The electromagnetically actuated fuel injection valve according to claim 1, wherein:

the space having a volume greater than a breathing volume of the electromagnetically actuated fuel injection valve during a normal operating temperature range.

5. The electromagnetically actuated fuel injection valve according to claim 1, comprising:

an armature;

a core interacting with the armature, the core having a first section;

a coil-carrier concentrically surrounding the first section of the core; and a magnet coil partially surrounded by the coil-carrier, the magnet coil, the valve housing, the core, and the coil-carrier defining a coil space;

wherein the valve housing further has a bore hole connecting the coil space to the valve housing.

6. The electromagnetically actuated fuel injection valve according to claim 5, further comprising a plastic electrical connecting plug including at least two contact pins for exciting the magnet coil.

7. The electromagnetically actuated fuel injection valve according to claim 1, wherein:

the valve housing has a first stepped configuration; and the protective sleeve has a second stepped configuration substantially identical to the stepped configuration of the valve housing.

8. The electromagnetically actuated fuel injection valve according to claim 1, wherein the valve housing includes a ferromagnetic material.

9. The electromagnetically actuated fuel injection valve according to claim 1, wherein the protective sleeve surrounds the valve housing completely in a radial direction.

10. An electromagnetically actuated fuel injection valve comprising:

a valve housing;

a protective sleeve having a first end and a second end, the protective sleeve surrounding the valve housing such that at least one space is formed between the first end of the protective sleeve and the valve housing; and a plastic covering being connected in a leak-tight manner to the second end of the protective sleeve, wherein the protective sleeve further includes a plurality of ribs and an inner wall, the plurality of ribs protruding radially inward from the inner wall of the protective sleeve and into the space and subdividing the space.

11. An electromagnetically actuated fuel injection valve comprising:

a valve housing;

a protective sleeve having a first end and a second end, the protective sleeve surrounding the valve housing such that at least one space is formed between the first end of the protective sleeve and the valve housing; and plastic covering being connected in a leak-tight manner to the second end of the protective sleeve, wherein the protective sleeve further includes a plurality of ribs and an inner wall, the plurality of ribs being arranged in a substantially circular shape, interleaved into the space and subdividing the space.

* * * * *

UNITED STATES PATENT AND TRADEMARK OFFICE

CERTIFICATE OF CORRECTION

PATENT No. : 5,634,597

DATED : June 3, 1997

INVENTOR(S): Klaus-Henning Krohn et al.

It is certified that error appears in the above-identified patent and that said Letters Patent is hereby corrected as shown below:

Column 2, line 58, after "core", insert --4.--.

Column 6, line 16, before "plastic", insert --a--.

Signed and Sealed this

Twenty-fifth Day of November, 1997

*Attest:*

*Attesting Officer*

BRUCE LEHMAN

*Commissioner of Patents and Trademarks*